United States Patent [19]

Lancellotti

[11] Patent Number: 4,625,963

[45] Date of Patent: Dec. 2, 1986

[54] EXERCISE APPARATUS

[76] Inventor: William E. Lancellotti, 100 Brookwood Dr., Johnston, R.I. 02919

[21] Appl. No.: 751,369

[22] Filed: Jul. 2, 1985

[51] Int. Cl.[4] ..... A63B 21/02

[52] U.S. Cl. ..... 272/135; 272/136; 272/67; 272/73

[58] Field of Search ..... 272/67, 73, 68, 135, 272/136, 93; 280/289 H

[56] References Cited

U.S. PATENT DOCUMENTS

| | | | |
|---|---|---|---|
| 3,649,008 | 3/1972 | Zinken et al. | 272/67 |
| 3,759,512 | 9/1973 | Yount et al. | 272/73 X |
| 3,947,025 | 3/1976 | Hobby, Jr. | 272/67 |
| 3,966,201 | 6/1976 | Mester | 272/73 X |
| 4,332,380 | 6/1982 | Cardin | 272/67 X |
| 4,463,945 | 8/1984 | Spector | 272/73 |

*Primary Examiner*—Richard J. Apley
*Assistant Examiner*—John L. Welsh
*Attorney, Agent, or Firm*—Salter & Michaelson

[57] ABSTRACT

An exercise apparatus comprises a base member, a pair of resiliently flexible exercise elements attached to the base member and a mounting assembly for mounting the apparatus on a supporting structure, such as an exercise cycle. The apparatus is operable by an operator by resiliently bending the exercise elements with the hands and arms to obtain exercise in the upper portions of the body and when it is mounted on an exercise cycle it is operable simultaneously therewith to provide enhanced cardiovascular exercise.

6 Claims, 7 Drawing Figures

EXERCISE APPARATUS

BACKGROUND AND SUMMARY OF THE INVENTION

The instant invention relates to exercise apparatus and more particularly to an exercise apparatus which is manually operable by an operator for gaining exercise in the upper portions of the operator's body.

A number of exercise apparatus have been developed in recent years as a result of the increased recognition of the importance for persons to obtain adequate physical exercise. In this regard, a variety of different types of exercise cycle apparatus have been developed which are operable by users thereof for obtaining exercise which is similar to that which can be obtained by riding a bicycle. In addition, a number of types of combination exercise cycle apparatus which include means for obtaining additional exercise in the upper portions of the body have also be developed. For example, the U.S. patents to BÜSCHER, U.S. Pat. No. 3,075,766, ZENT, U.S. Pat. No. 3,213,852, ODOM, U.S. Pat. No. 3,216,722, MORGAN, U.S. Pat. No. 3,601,395, YOUNT et al, U.S. Pat. No. 3,759,512, GLASSER et al, U.S. Pat. No. 3,727,913, CARNIELLI, U.S. Pat. No. 3,964,742, MESTER, U.S. Pat. No. 3,966,201, and ZENT, U.S. Pat. No. 4,071,235 relate to combination exercise cycle apparatus of this general type and represent the closest prior art to the instant invention of which the applicant is aware. However, since these references fail to suggest a device which is operable in a manner similar to the apparatus of the instant invention for obtaining effective and beneficial exercise, and since they also fail to suggest a device which embodies the structural features of the apparatus of the instant invention, they are believed to be of only general interest.

The instant invention provides an effective apparatus which is operable for obtaining highly beneficial exercise in the upper portions of the human body. More specifically, the apparatus of the instant invention is operative in combination with a supporting structure which preferably comprises a seating apparatus such as an exercise cycle or a wheelchair, for enabling a person to obtain exercise in the upper portions of the body. The apparatus of the instant invention comprises a base member, an elongated resiliently flexible exercise element attached at one end thereof to the base member, and means for mounting the base member and the exercise element on a supporting structure, such as a seating apparatus, so that when a person is disposed on or adjacent the supporting structure, the exercise element can be manipulated with the hands and arms to provide exercise for the person. Preferably, the apparatus comprises a pair of the resiliently flexible exercise elements which are attached to the base member in spaced relation and the exercise elements preferably comprise coil springs so that they are universally resiliently flexible. The base member preferably comprises a cylindrical rod and the exercise elements are preferably adjustably securable to the base member in a plurality of different radially extending positions and alternatively they are securable so that they are rotatable around the axis of the rod but longitudinally fixed with respect thereto.

Preferably, the apparatus of the instant invention is mounted on a seating apparatus which comprises an exercise cycle, and it is positioned so that the exercise elements are located in front of the seat portion of the exercise cycle. The pedals of the exercise cycle can then be manipulated or pumped by a user of the apparatus in a conventional manner with the users legs and feet while the exercise elements are reciprocally flexed in opposite directions with the user's arms. When, the apparatus of the instant invention is utilized in this manner it provides increased exercise in the upper portions of the body as a result of the work required to resiliently flex the exercise elements and this substantially increases the amount of cardiovascular exercise which is obtained by the user. In addition, because the exercise elements are universally flexible, the apparatus can be operated to achieve exercise in a number of different muscles in the upper portions of the body and because the exercise elements are securable at various different positions on the base member, a number different types of exercise can be obtained with the apparatus of the instant invention.

Accordingly, it is a primary object of the instant invention to provide an apparatus for achieving effective exercise in the upper portions of the body.

Another object of the instant invention is to provide an apparatus which is operable in combination with an exercise cycle for providing increased exercise in the upper portions of the body during the use of the exercise cycle.

A still further object of the instant invention is to provide an exercise apparatus comprising a resiliently flexible exercise element which is operable by a user with the hands and arms for gaining effective exercise in the upper portions of the body.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
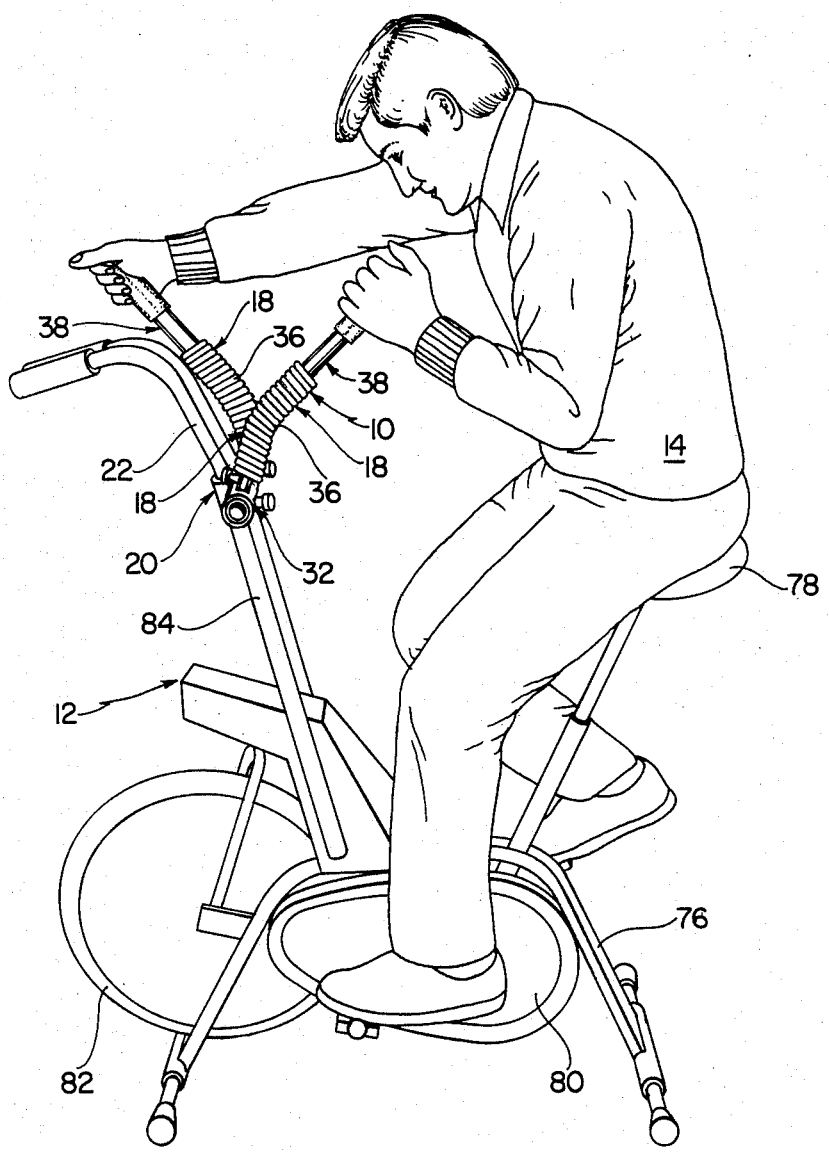
FIG. 1 is a perspective view illustrating the use of the apparatus of the instant invention in combination with an exercise cycle.
Figure 2:
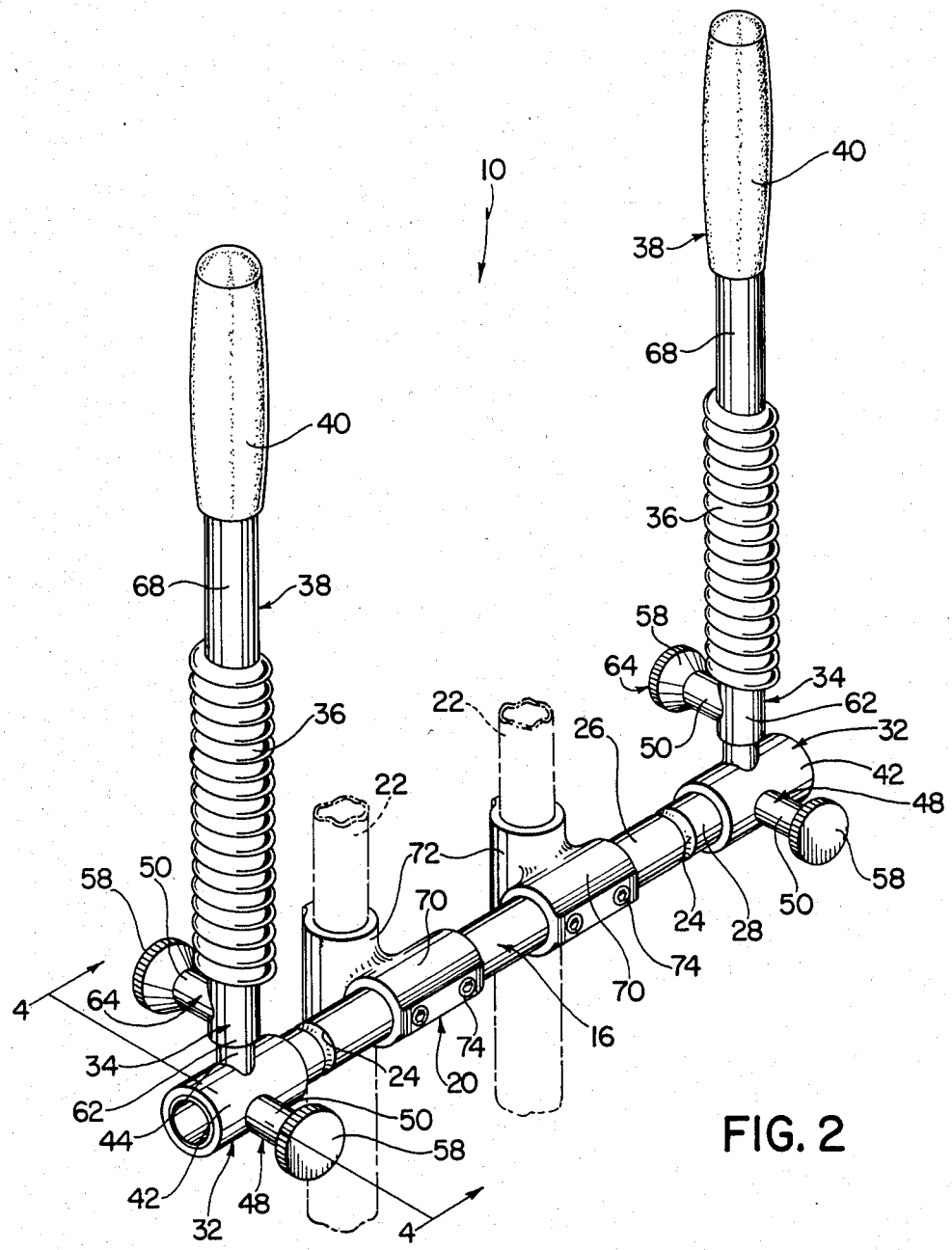
FIG. 2 is a perspective view of the apparatus of the instant invention mounted on the handlebar portion of an exercise cycle.
Figure 3:
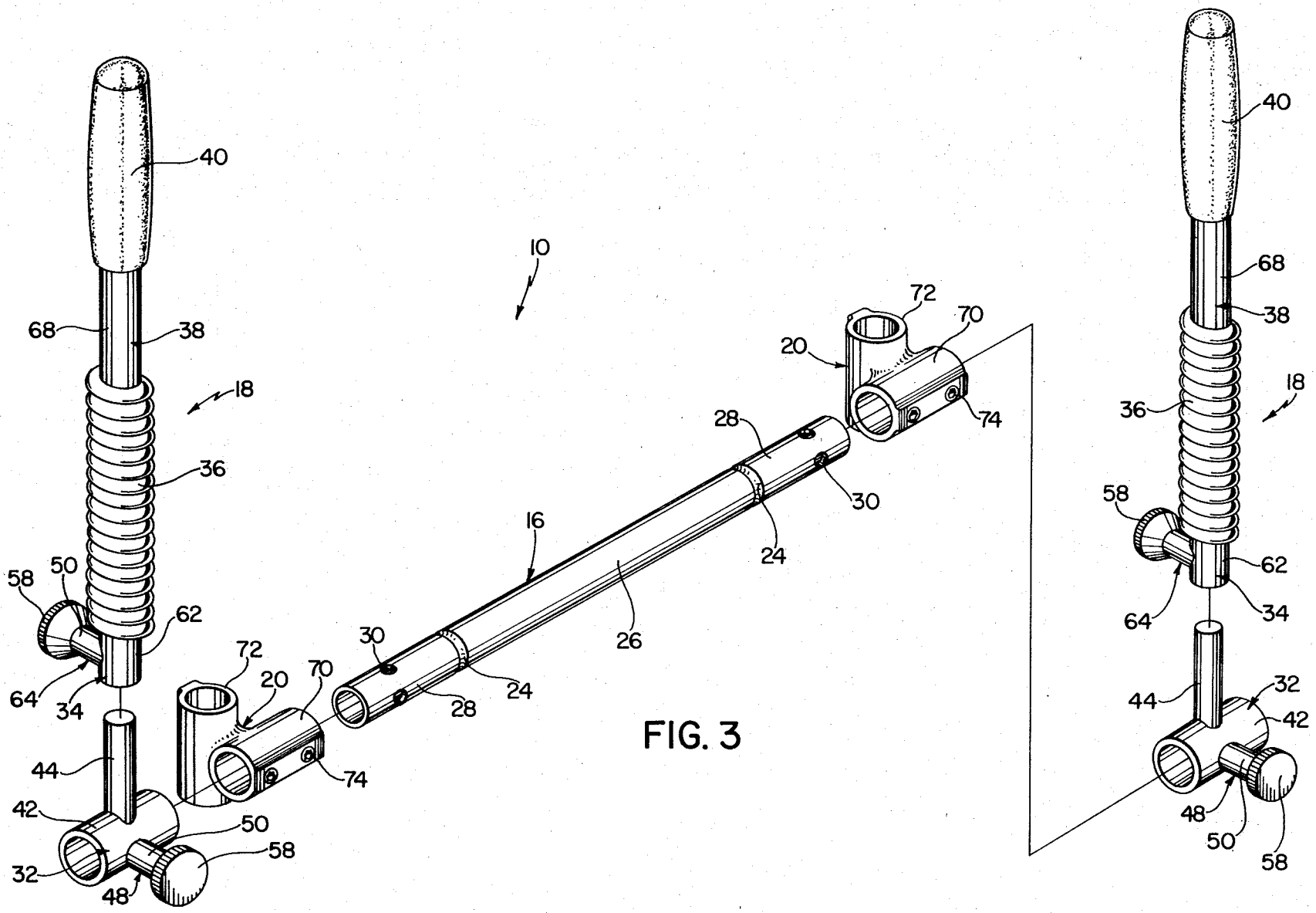
FIG. 3 is an exploded perspective view of the apparatus.

Referring now to the drawings, the apparatus of the instant invention is illustrated and generally indicated at 10 in FIGS. 1 through 3. As illustrated in FIG. 1, the apparatus 10 is operable in combination with an exercise cycle 12 by an operator 14 for providing effective exercise in the upper portions of the body of the operator 14, particularly during the operation of the exercise cycle 12. It will be understood, however, that the apparatus 10 is also operable in combination with various other types of seating apparatus, including wheelchairs, for gaining effective exercise in the upper portions of the body. As will be seen from FIGS. 2 and 3, the apparatus 10 comprises a cylindrical base member generally indicated at 16, a pair of exercise elements generally indicated at 18, and a pair of mounting brackets generally indicated at 20. The exercise elements 18 are secured to the base member 16 so that they extend outwardly therefrom in spaced relation and the mounting brackets 20 are secured to the base member 16 between the exercise elements 18 so that they are operative for securing the apparatus 10 to a pair of handlebar elements 22 on the exercise cycle 12.

Referring further to FIGS. 2 and 3, the base member 16 is clearly illustrated. As will be seen, the base member 16 comprises an elongated member of cylindrical tubular configuration having a pair of spaced circumferential grooves 24 therein which define a central portion 26 of the base member 16 therebetween and a pair of end portions 28. Each of the end portions 28 is formed with a plurality of circumferentially spaced apertures 30 therein, as illustrated in FIG. 3.

Figure 4:
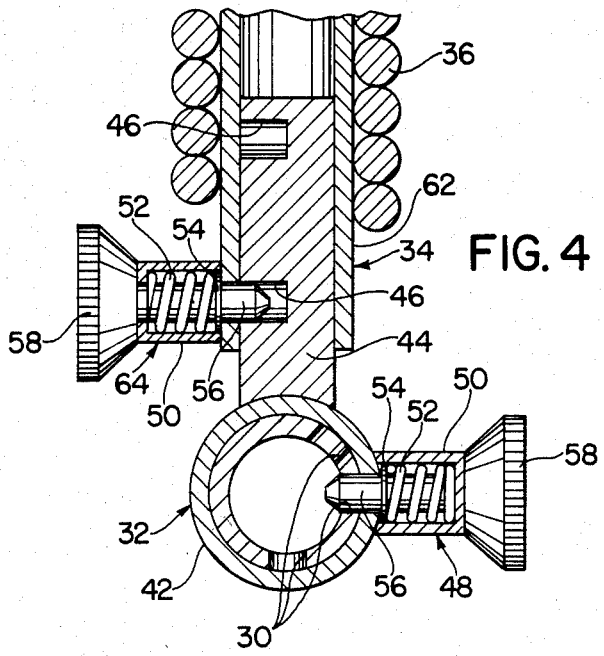
FIG. 4 is a sectional view taken along line 4—4 in FIG. 2.
Figure 5:
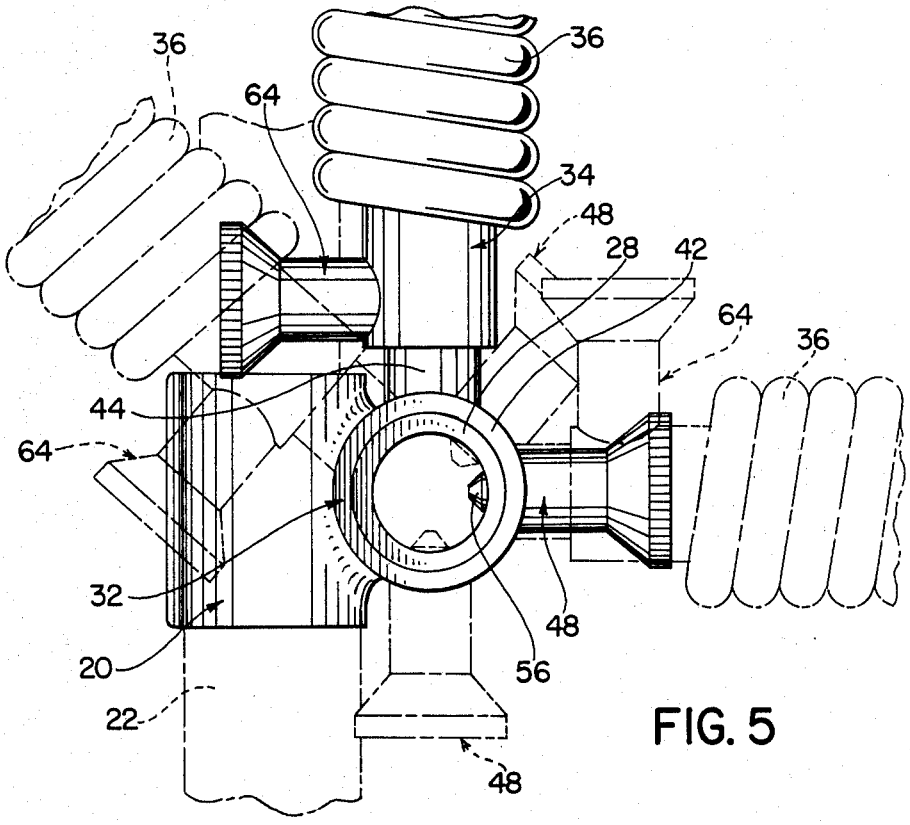
FIG. 5 is a fragmentary elevational view illustrating the various radial positions of the exercise elements with respect to the base member thereof.
Figure 6:
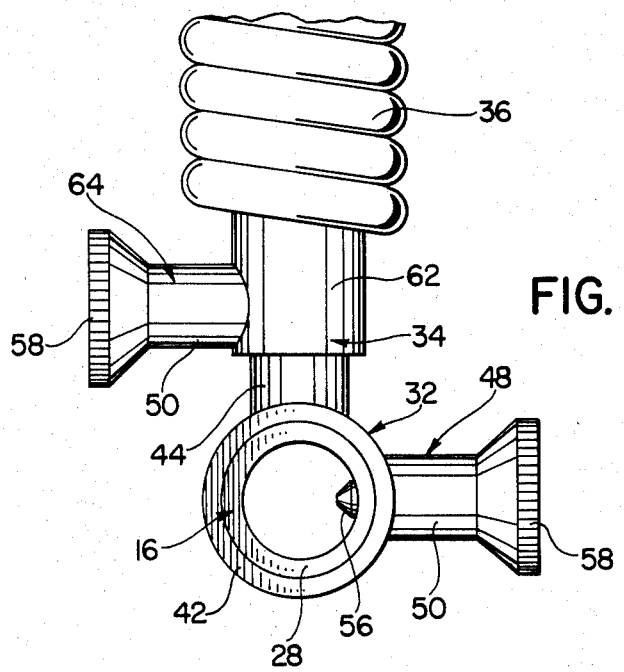
FIGS. 6 and 7 are end elevational views illustrating the adjustability in the length of one of the exercise elements of the apparatus.
Figure 7:
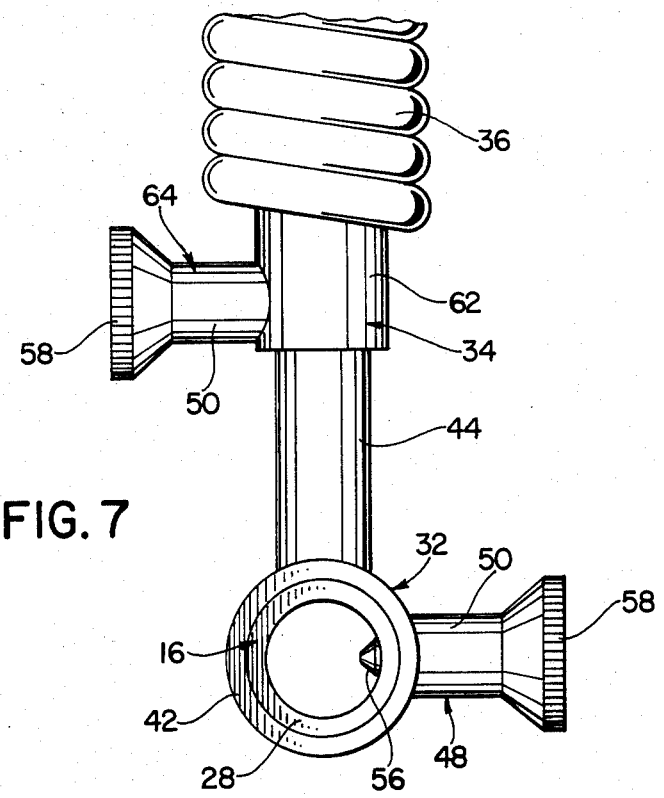

The exercise elements 18 each comprise a mounting portion generally indicated at 32, a sleeve portion generally indicated at 34, a coil spring 36, and a terminal portion 38 having a handle grip 40 thereon. The mounting portions 32 each comprise a tubular portion 42 which is dimensioned to be rotatably and slidably received on the base member 16, a stem portion 44 having a plurality of longitudinally spaced bores 46 therein (see FIG. 4), and a first spring loaded pin assembly 48. The stem portion 44 of each of the mounting portions 32 is attached to its respective tubular portion 42 so that it extends outwardly therefrom in substantially perpendicular relation and the first pin assembly 48 of each of the mounting portions 32 is attached to its respective tubular portion 42 so that it extends outwardly therefrom in circumferentially spaced relation from its respective stem portion 44. In this regard, as illustrated most clearly in FIG. 4, the first pin assemblies 48 each comprise an outer tubular housing 50 which is attached to the respective tubular portion 42 thereof, a coil spring 52 which is received in the respective housing 50 thereof, a retaining washer 54 which is received in the respective housing 50 thereof between the spring 52 thereof and the respective tubular portion 42 thereof, and a pin element 56 to which a knob 58 is attached. Each of the pin elements 56 extends axially through its respective spring 52 and washer 54, and it communicates with the interior of its respective tubular portion 42 through an aperture 60 therein. The pin elements 56 are dimensioned to be received in their respective apertures 30 for adjustably securing their respective exercise elements 18 on the base member 16 as will hereinafter be more fully set forth. Each of the sleeve portions 34 of the exercise elements 18 comprises a tubular sleeve 62 and a second spring loaded pin assembly 64. The second pin assemblies 64 are substantially the same as the first spring loaded pin assemblies 48, and they each comprise a housing 50, a spring 52, a washer 54, a pin 56, and a knob 58. The second spring loaded pin assemblies 64 of the exercise elements 18 are secured to their respective tubular sleeves 62 in substantially perpendicular relation and the pin elements 56 of the sleeve portion 34 thereof communicate with the interiors of their respective tubular sections 62 through apertures 66 therein. The pin elements 56 of the assemblies 64 are dimensioned to be received in the bores 46 in their respective stem portions 44 for adjustably securing their respective sleeve portions 34 on the adjacent stem portions 44. Each of the coil springs 36 comprises a resiliently flexible coil spring element having a resiliency which allows it to be flexed by an operator of the apparatus 10 to achieve a suitable level of exercise. The coil springs 36 are frictionally received on their respective sleeve portions 34 to permanently secure them thereto. Each of the terminal portions 38 comprises a substantially rigid tubular member 68, which is frictionally received in an end of its respective coil spring 36 to permanently secure it thereto, and the handle grip 40 of each of the terminal portions 38 is received over the end of the tubular member 68 thereof. In this regard, the handle grips 40 are preferably permanently secured on their respective tubular members 68 and they are dimensioned and configured to provide handle grips which can be comfortably grasped by an operator of the apparatus 10 for manipulating the exercise elements 18 to resiliently bend the coil springs 36, thereof.

The mounting brackets 20 each comprise integrally formed first and second clamping elements 70 and 72, respectively, which are each of generally tubular configuration and which are disposed in substantially perpendicular relation with respect to each other. The first and second clamping elements 70 and 72 of the mounting brackets 20 are dimensioned to be slidably received on the base member 16 and on the handlebar elements 22, respectively, and they each further comprise a plurality of set screws 74 which are threadedly received therein so that they communicate with the interiors of the clamping elements 70 and 72 for adjustably securing the base member 16 in the mounting brackets 20 and for securing the apparatus 10 on the handlebar elements 22. In this regard, however, it should be pointed out that although the mounting brackets 20 are adapted for mounting the apparatus 10 on the exercise cycle 12, it will be understood that a variety of other embodiments of the apparatus of the instant invention which are adapted to be mounted on other types of apparatus, including other types of seating apparatus, are contemplated.

The exercise cycle 12 comprises a conventional exercise cycle having a frame 76, a seat 78 mounted on the frame 76, a pedal assembly 80, a wheel assembly 82 which includes a frictional drag (not shown), a pair of handlebar mounting elements 84, and the handlebar elements 22, and it is operable in a manner similar to a conventional bicycle. More specifically, the exercise cycle 12 is operable by manually pedalling the pedal assembly 80 to rotate the wheel assembly 82 so that the frictional drag of the wheel assembly 82 provides a predetermined resistance to the pedalling motion of the operator 14 to enable the operator 14 to obtain a desired degree of exercise from the use of the exercise cycle 12.

In order to install the apparatus 10 on the exercise cycle 12, the handlebar elements 22 are preferably moved to the forwardly extending positions thereof illustrated in FIG. 1 and the mounting brackets 20 are assembled over the handlebar elements 22 and secured thereto with the appropriate set screws 74. The base member 16 is then secured to the first mounting elements 70 of the brackets 20 in a similar manner, and the sleeves 42 of the mounting portions 32 are assembled over the end portions 28. The exercise elements 18 are then secured in the desired orientations by pulling the knobs 58 of the first pin assemblies 48 outwardly, aligning the respective pin elements 56 thereof with the appropriate apertures 30, and then releasing the knobs 58 so that the pin elements 56 thereof are received in the appropriate apertures 30. Alternatively the exercise elements 18 are secured to the base member 16 so that the pin elements of the first pin assemblies 48 are received in the grooves 24, whereby the exercise elements 18 are freely rotable about the base member 16. The lengths of the exercise elements 18 are adjustable as desired by manipulating the second spring loaded pin assemblies 64 in a manner similar to that hereinabove described so that the pin elements 56 thereof are received in the appropriate bores 46.

For use and operation of the apparatus 10, the operator 14 is positioned on the seat 78 and the handle elements 40 are grasped with the hands of the operator 14. The exercise elements 18 are then manipulated by the operator 14 so that the coil springs 36 thereof are resiliently bent in various different directions. In this regard, when the pins 56 are received in the apertures 30, this may be done by moving the arms forwardly and rearwardly in opposite directions in a reciprocating motion, although it will be apparent that the universally flexible exercise elements 18 can be manipulated in a variety of different ways to achieve a variety of different types of exercise as desired. Preferably the apparatus 10 is utilized in combination with the foot pedal assembly 80 of the exercise cycle 12 to provide enhanced cardiovascular activity for the operator 14 and to simultaneously provide effective and beneficial exercise for both the upper and the lower portions of the body. In order to obtain different forms of exercise with the apparatus 10, both the positions of the exercise elements 18 relative to the base member 16 and the lengths of the exercise elements 18 can be adjusted in the manner hereinabove set forth. The apparatus 10 is also operable in a somewhat different manner by positioning the exercise elements 18 so that the pin elements 56 of the first pin assemblies 48 are received in the grooves 24. This allows the exercise elements 18 to be rotated around the base member 16, while nevertheless retaining the exercise elements 18 in a manner which allows them to be flexed inwardly and outwardly with respect to the base member 16 to provide exercise for the operator 14.

It is seen, therefore, that the instant invention provides an apparatus which is effective for obtaining a beneficial form of exercise in the upper portions of the human body. The apparatus 10 can be utilized for strengthening and exercising the muscles in the upper portions of the body and also for providing effective and beneficial cardiovascular exercise. Further, when the apparatus 10 is utilized in combination with the exercise cycle 12, it can be operated with the same rythmic movements which are associated with pedalling the cycle 12 and substantial amounts of exercise can be obtained in relatively short periods of time. Further, because the exercise elements 18 are effectively adjustable to a variety of different positions, the apparatus 10 can be manipulated to provide a variety of different types of exercise in the upper portions of the body. Hence, it is seen that for these reasons as well as the other reasons hereinabove set forth, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An exercise apparatus comprising:

a. an elongated cylindrical base member;

b. means for mounting said base member in nonrotatable relation on a supporting structure;

c. a pair of elongated resiliently flexible exercise elements each including longitudinal adjustment means for adjusting the outward extent of each said exercise element with respect to the base member; and d. means independently and adjustably securing each of said exercise elements to said base member in a plurality of different positions at radially spaced locations around the circumference of said cylindrical base member.

2. In the exercise apparatus of claim 1, said exercise element securing means securing said exercise elements so that they are independently repositionable along the longitudinal extent of said base member.

3. In the exercise apparatus of claim 1, said base member having a plurality of apertures therein in at least two spaced locations in the longitudinal extent thereof, said exercise element securing means being engageable with said base member in different apertures therein for adjustably securing said exercise elements with respect to said base member.

4. In the exercise apparatus of claim 1, said exercise element securing means further being alternatively operable for independently securing said exercise elements to said base member so that they are independently rotatable about said base member.

5. In the exercise apparatus of claim 3, said base member having at least two spaced circumferential grooves therein, said exerecise element securing means being engageable with said base member in said grooves for alternatively independently securing said exercise elements to said base member so that they are independently rotatable about said base member.

6. The exercise apparatus of claim 1 in combination with an exercise cycle, said base member being mounted on said exercise cycle so that said exercise elements are manipulatable by an operator seated on the seat of said exercise cycle by grasping said exercise elements with the hands and resiliently flexing said exercise elements.

* * * * *